United States Patent [19]

Toth, Jr.

[11] 3,978,830

[45] Sept. 7, 1976

[54] SNAP-ON SPRING RETAINER LOCK

[75] Inventor: Ernest J. Toth, Jr., South Euclid, Ohio

[73] Assignee: TRW Inc., Cleveland, Ohio

[22] Filed: Jan. 13, 1975

[21] Appl. No.: 540,588

[52] U.S. Cl. ..... 123/90.67; 123/188 AF

[51] Int. Cl.[2] ..... F01L 3/10

[58] Field of Search..... 123/90.28, 90.29, 90.65, 123/90.66, 90.67, 188 SB, 188 AF, 188 SA; 251/337

[56] References Cited

UNITED STATES PATENTS

| | | | |
|---|---|---|---|
| 3,021,593 | 2/1962 | Cousino | 123/90.67 |
| 3,077,874 | 2/1963 | Bush | 123/90.67 |
| 3,110,298 | 11/1963 | Giles | 123/90.67 |
| 3,164,336 | 1/1965 | Tauschek | 251/337 |
| 3,815,873 | 6/1974 | Hendrick | 251/337 |

*Primary Examiner*—Wendell E. Burns
*Assistant Examiner*—David D. Reynolds

[57] ABSTRACT

A snap-on type spring retainer lock comprises a one-piece stamped retainer element which has resilient spring fingers which encircle and clamp against a tapered surface portion of a valve stem. A spring retainer is held on the valve stem by the abutting engagement of the spring retainer with the retainer lock. The retainer lock has a base portion from which the spring fingers project. The base portion is adapted to cover the tip end of the valve stem and acts as a bearing surface for a mechanism for driving the valve.

6 Claims, 5 Drawing Figures

SNAP-ON SPRING RETAINER LOCK

BACKGROUND OF THE PRESENT INVENTION

The present invention relates to a snap-on type spring retainer lock which is suitable for use in association with a valve for an internal combustion engine or the like.

It is well known that valves are utilized in internal combustion engines and that the valves are biased by a suitable spring to a closed position and are opened by a mechanism for driving the valve, such as by a rocker arm or the like. The spring which acts to bias the valve to a closed position normally acts between the cylinder head or the like and a spring retainer which is carried on the valve stem. The retainer is normally held on the valve stem against the spring bias by a spring retainer lock. The prior art is replete with a variety of different types of spring retainer locks for holding the retainer on the valve stem in opposition to the force applied thereto by the spring. Typical valve retainer locks are shown in U.S. Pat. Nos. 1,393,348; 1,947,534; 1,965,718; 3,043,284; and 3,077,874.

SUMMARY OF THE PRESENT INVENTION

The present invention is directed to an improved snap-on type spring retainer lock for use with a valve stem. The retainer lock of the present invention not only serves to hold the spring retainer on the valve stem, but also serves as a wear surface for the tip of the valve stem. Further, the improved spring retainer lock of the present invention has substantial advantages in that it is constructed to be self-piloting and self-aligning during assembly with the valve stem. It also is constructed so as to be capable of automated assembly with the valve stem. Moreover, in view of the fact that the spring retainer lock provides a wear-resistant surface at the valve stem tip, there is an elimination of handling and other treating operations on the valve stem.

Further, the spring retainer lock of the present invention is of a one-piece cup-shaped construction made from strip steel or other suitable material by a stamping process. The retainer lock has a base which covers the valve tip and acts as the wear-resistant surface and has a plurality of spring fingers which are adapted to clamp on a tapered surface of the valve stem. The cup-shaped construction defines a frusto-conical chamber in which the valve stem is adapted to be located. Upon assembly the spring fingers engage a surface portion of the valve stem and move radially outwardly thereof by the force of that engagement as the lock and valve stem are moved toward each other. The fingers are moved outwardly by a cam surface or the like on the valve stem and when the fingers pass that surface, they return toward their original position into a tight clamping engagement with the valve stem due to their resiliency. At that time, the wear-resistant base of the retainer abuttingly engages the tip of the valve stem and the mechanism which operates the valve engages the base of the lock rather than the valve stem tip.

DETAILED DESCRIPTION OF THE FIGURES

Further objects and advantages of the present invention will be apparent to those skilled in the art to which it relates from the following detailed description thereof made with reference to the accompanying drawings in which.

DESCRIPTION OF THE PREFERRED EMBODIMENT

As noted above, the present invention is directed to a snap-on valve spring retainer lock which is adapted to be used in association with valves used in an internal combustion engine. As noted above, the spring retainer lock is adapted to act to hold the spring retainer in position on the valve stem. The snap-on type valve spring retainer lock of the present invention may take a variety of different structural forms and shapes. The lock may be stamped from pre-heat treated steel or stamped, formed and later heat-treated for hardness. However, as representative of the present invention, the drawings illustrate a valve spring retainer lock, generally designated 10.

Figure 1:
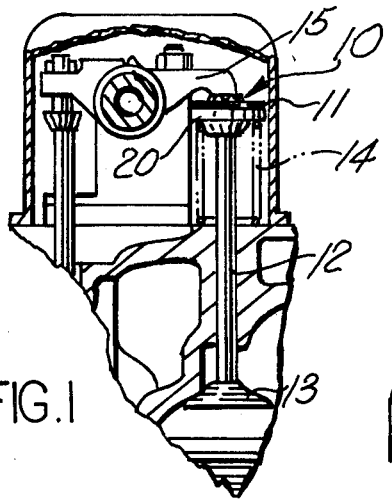
FIG. 1 is a schematic view illustrating a valve assembly having a snap-on type valve spring retainer lock of the present invention.

As shown in FIG. 1, the retainer lock 10 is adapted to cooperate with a spring retainer 11 and to hold the spring retainer 11 on a valve stem 12. The valve stem 12 carries on its lower end, as shown in FIG. 1, a valve member 13 which is biased into a closed position by a valve spring 14. The valve spring 14 acts between the spring retainer 11 and the cylinder head in which the valve 13 is located. In order to drive the valve 13 to its open position in opposition to the bias of the spring 14, a suitable drive arrangement, which includes a rocker arm 15, is provided. The rocker arm 15 is actuated in any conventional manner and will not be described herein.

Figure 2:
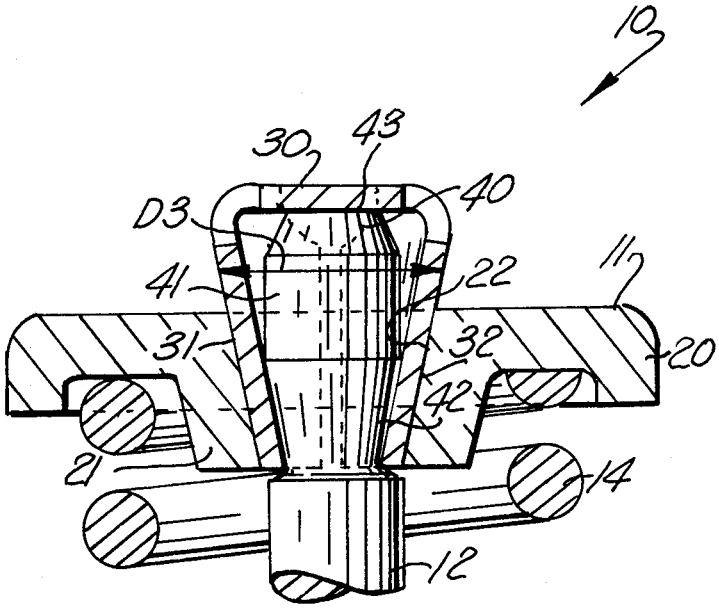
FIG. 2 is an enlarged sectional view of a portion of FIG. 1 showing the position of the valve spring retainer lock holding the spring retainer in position on the valve stem.

The valve spring retainer 11 is shown in an enlarged view in FIG. 2 in its assembled relationship with the retainer lock 10. The spring retainer 11 comprises a disc member which has an outer flange 20 and an inner hub or projecting portion 21 which defines an opening 22 therethrough. The opening 22 is generally fursto-conical in shape and is defined by a conical surface which tapers inwardly as it extends away from the upper tip of the valve stem 12 downwardly along the valve stem 12. The spring 14 is adapted to engage the spring retainer in the area between the projecting portion 21 and the flange 20.

The snap-on valve spring retainer lock 10 is a one-piece generally cup-shaped member. The retainer lock is of simple construction which can be readily manufactured by a stamping process from sheet metal. The retainer lock 10 includes a base portion 30 from which a plurality of spring fingers 31, 32, 33 and 34 extend. The fingers 31–34 taper toward each other or converge as they extend from the base portion 30. The fingers 31–34 are separated by spaces and, at the interconnection of the fingers to the base portion 30, cutouts are provided which, in effect, control the resiliency of the fingers by controlling the area of the interconnection between the fingers and the base. The retainer lock 10 is constructed so that the diameter D between the outer ends of the spring fingers is less than the diameter D2 of the valve stem, at the area indicated in FIG. 3.

It should be clear from the drawings that the base 30 comprises a disc portion having an uninterrupted surface and that the spring fingers are connected to the base at the periphery thereof. The base and the fingers are formed of sheet metal and are of substantially the same uniform thickness throughout. Further, it should be clear that the base portion 30 is flat in the preferred embodiment.

Figure 3:
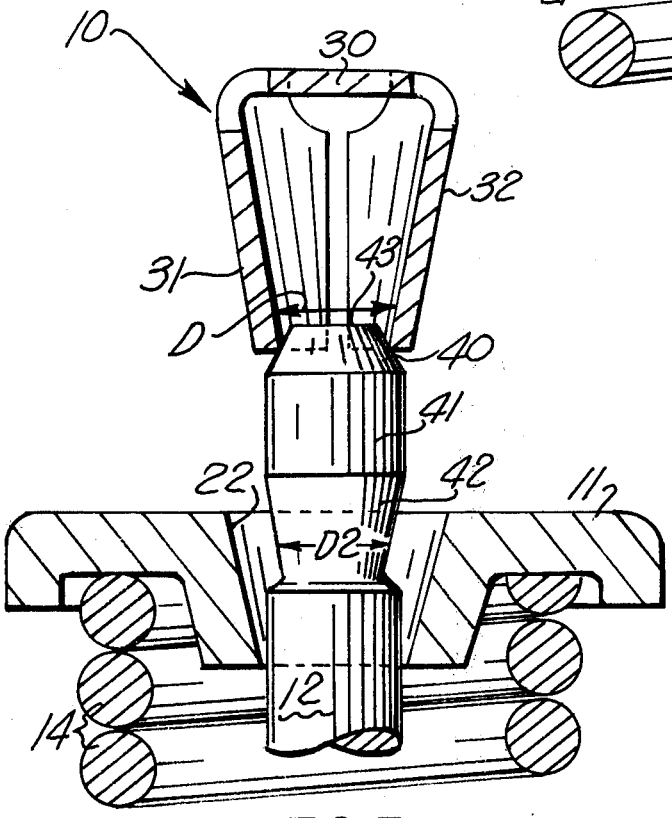
FIG. 3 is a view illustrating the parts during the assembly operation and prior to complete assembly of the parts.
Figure 4:
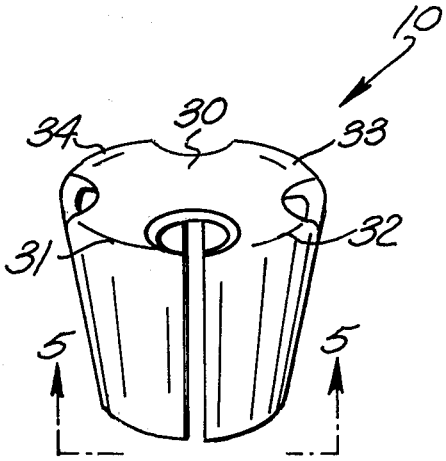
FIG. 4 is a view of the valve spring retainer lock itself.
Figure 5:
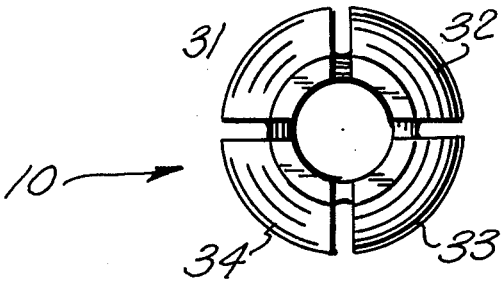
FIG. 5 is a view taken approximately along the line 5—5 of FIG. 2.

As shown in FIG. 3, for purposes of assembling the snap-on type valve spring retainer lock 10 on the valve stem 12, the parts are first positioned as shown in FIG. 3. In this position, the spring retainer 11 has been inserted over the end of the valve stem and with the spring 14 slightly compressed. The snap-on spring retainer lock 10 is positioned in alignment with the valve stem 12.

The outer end of the valve stem 12 includes a tapered surface portion 40 and as the valve stem and spring retainer lock 10 are moved toward each other, the tapered surface portion 40 engages the outer tips of the spring fingers 31–34 and forces them outwardly. On continuing movement of the lock 10 onto the valve stem 12, the spring fingers 31–34 engage a cylindrical surface portion 41 of the valve stem, which surface portion maintains the spring fingers in an outward position. After the tips of the spring fingers pass beyond the cylindrical surface portion 41 of the valve stem, they come into engagement with a tapered surface portion 42. The tapered surface portion 42 of the valve stem is tapered at substantially the same angle as the taper of the surface defining the opening 22 of the spring retainer. When the spring fingers engage the tapered surface 42, they tend to move toward each other and into tight clamping engagement with the surface of the valve stem. The movement of the retainer lock 10 continues onto the valve stem 12 until the base portion 30 thereof abuts the tip end 43 of the valve stem 12. At this time, clamping forces between the spring fingers 31–34 and the valve stem 12 are provided to hold the lock 10 on the valve stem 12.

Since the cross-sectional dimension of the tapered surface portion 42 is greater than the corresponding free dimension of the spring fingers 31–34 (diameter D being greater than D2), the fingers 31–34 resiliently but firmly clamp on the valve stem 12. As a result of the assembly operation, the spring fingers tightly clampingly engage the tapered surface portion 42 of the valve stem and the frictional, tight clamping engagement between the spring fingers holds the snap-on valve retainer lock 10 on the valve stem.

Once the snap-on valve spring retainer lock 10 is clampingly engaged with the valve stem 12, the spring 14 is released so that the spring retainer 11 is moved by the spring into abutting engagement with the retainer lock 10. In this connection, the parts then take the position shown in FIG. 2, in which the surface defining opening 22 of the spring retainer 11 engages the outer surface of the spring fingers 31–34. Of course, the diameter D3 of the outer portion or top portion (as shown in FIG. 3) of the retainer lock 10 is substantially greater than the largest diameter of the opening in the retainer 11. Therefore, the retainer 11 is held on the valve stem 12 against the biasing force of the spring 14, due to the fact that the frictional clamping forces between the spring fingers 31–34 and the valve stem 12 are such that the force of the spring 14 cannot force the retainer 10 off the valve stem 12.

From the above, it should be apparent that applicant has provided a simple valve spring retainer lock 10 which is capable of ready assembly with the valve stem 12 and which lends itself to automatic assembly. In addition, it should be clear that the snap-on valve spring retainer lock 10 is self-piloting and aligning during installation. No aligning problems occur because of the action between the valve stem 12 and the retainer lock 10 during the assembly operation. Furthermore, it should be clear that the cost of the spring retainer lock 10 is relatively low, due to the fact that it is a one-piece stamped simplified construction.

Also, it should be clear that the base portion 30 of the retainer lock covers the outer tip of the valve stem 12 after assembly and the rocker arm 15 engages the base 30 of the retainer lock 10 rather than engaging the valve stem tip. As a result, the end of the valve stem 12 need not be treated for purposes of taking the force of the rocker arm 15 engaging the valve stem. Thus, the base portion 30 of the retainer lock 10 comprises a bearing means or wear surface for the outer tip of the valve stem 12. Also the fingers 31–34 are hardened to prevent "fretting" due to movement of the spring retainer 11 with respect to the lock.

Accordingly, it should be clear that the snap-on valve spring retainer lock 10 does have substantial advantages in that it is of a one-piece stamped construction, may be readily assembled with the valve stem, and not only provides the function of holding the retainer 11 on the valve stem 12, but also simultaneously provides a wear surface on the tip of the valve stem 12 which is engaged by the means which drives the valve.

Having described the invention, what is claimed is:

1. Apparatus for holding a spring retainer on a valve stem against the bias of a spring, said apparatus comprising a one-piece retainer lock member for insertion onto one end of a valve stem, said retainer lock member comprising a cup-shaped member having a base and a plurality of spring fingers for resiliently clampingly engaging the valve stem, said base and spring fingers defining a chamber for receiving said valve stem, said spring fingers having a generally frusto-conical outer surface and a frusto-conical inner surface, the frusto-conical outer surface of said spring fingers comprising means engageable with the spring retainer for holding the spring retainer on the valve stem against the bias of the spring.

2. Apparatus as defined in claim 1 wherein said chamber defined by said base and said fingers is generally frusto-conical in shape, and wherein said spring fingers project from said base and converge toward each other as they extend from said base, said base comprising a disc portion having an uninterrupted surface and said spring fingers being connected to said base at the periphery thereof.

3. Apparatus as defined in claim 2 wherein said disc and fingers are made of metal, said disc being substantially flat and the thickness of said disc and said fingers is substantially uniform throughout.

4. Apparatus comprising a stem having a valve at one end thereof, a spring for biasing said stem in one direction, a spring retainer located on said stem and against which said spring acts to move said stem in said one direction, a spring retainer lock for holding said spring retainer on said stem against axial movement by said spring bias, said spring retainer lock comprising a one-piece member having a base and a plurality of spring fingers which extend from said base, said spring fingers clampingly engaging said stem to secure said retainer lock on said stem, said retainer lock having surfaces which engage surfaces of said spring retainer to prevent movement of said spring retainer relative to said stem by said spring, and said base abutting the outer tip of said stem and providing a wear-resistant surface at said tip.

5. Apparatus as defined in claim 4 further including a tapered pilot surface portion on said stem at the outer tip thereof and which is engageable with said spring fingers as said stem and retainer lock move toward each other to move said spring fingers outwardly as said retainer lock and stem move together.

6. Apparatus as defined in claim 4 wherein said retainer lock comprises a generally cup-shaped member defining a frusto-conical chamber, and wherein said spring fingers project from said base and converge toward each other to define such chamber, said stem including a tapered surface portion against which said spring fingers clampingly engage when assembled with said valve stem, and said spring retainer having a corresponding tapered passage therethrough into which said fingers extend, and said surface of said spring retainer engaging the outer surface of said spring fingers to prevent movement of said spring retainer in said one direction.

* * * * *